US006505578B1

(12) United States Patent
Scott et al.

(10) Patent No.: US 6,505,578 B1
(45) Date of Patent: Jan. 14, 2003

(54) APPARATUS AND METHOD FOR DISPOSING OF PET WASTE

(76) Inventors: Samuel Scott, 36 Pottery Crescent, Brampton, Ontario (CA), L6S 3S3; Lourine J. Scott-Osamusali, 82-2665 Thomas St., Mississauga, Ontario (CA), L5M 6G6

( * ) Notice: Subject to any disclaimer, the term of this patent is extended or adjusted under 35 U.S.C. 154(b) by 0 days.

(21) Appl. No.: 10/073,390

(22) Filed: Feb. 12, 2002

(51) Int. Cl.[7] ..... A01K 23/00; A01K 29/00

(52) U.S. Cl. ..... 119/867; 294/1.5; 294/1.3; 294/1.4

(58) Field of Search ..... 119/867; 294/1.5, 294/1.4, 1.3; 280/47.26

(56) References Cited

U.S. PATENT DOCUMENTS

| | | | | | |
|---|---|---|---|---|---|
| 955,908 | A | * | 4/1910 | Ross | 119/867 |
| 3,370,787 | A | * | 2/1968 | Lindholm et al. | 220/495.06 |
| 3,986,744 | A | * | 10/1976 | Krogstad et al. | 119/867 |
| 4,205,869 | A | * | 6/1980 | Mathis | 15/104.8 |
| 4,272,116 | A | | 6/1981 | Tufte, Jr. | |
| 4,440,410 | A | * | 4/1984 | Bradshaw | 141/231 |
| 4,875,729 | A | | 10/1989 | Peck | |
| 4,896,912 | A | | 1/1990 | Parnell | |
| 5,134,974 | A | * | 8/1992 | Houser | 119/165 |
| 5,156,427 | A | * | 10/1992 | Longrie et al. | 15/257.6 |
| 5,394,833 | A | | 3/1995 | Glass | |
| 5,400,572 | A | | 3/1995 | Peck | |
| 5,511,682 | A | * | 4/1996 | Pace | 220/230 |
| 5,713,616 | A | * | 2/1998 | Knudson | 206/223 |
| 6,227,149 | B1 | * | 5/2001 | Host et al. | 119/867 |

* cited by examiner

*Primary Examiner*—Charles T. Jordan
*Assistant Examiner*—Judith A. Nelson
(74) *Attorney, Agent, or Firm*—R. L. Mikesell

(57) ABSTRACT

An apparatus for disposing of pet waste including a housing defining a receiving opening and an internal storage area. A pair of control arms are slidably connected to opposite side walls of the housing and include a handle at first ends thereof for controlling the position of the control arms. An L-shaped door is pivotally connected at one end to a front wall of the housing adjacent the opening, and pivotally connected to the control arms so as to be movable between open and closed positions. To dispense of pet waste, the control arm handle is pulled forward to open the door, the receiving opening is placed behind the pet waste, and the handle is pushed to close the door and capture the pet waste within the housing.

11 Claims, 1 Drawing Sheet

FIG. 1
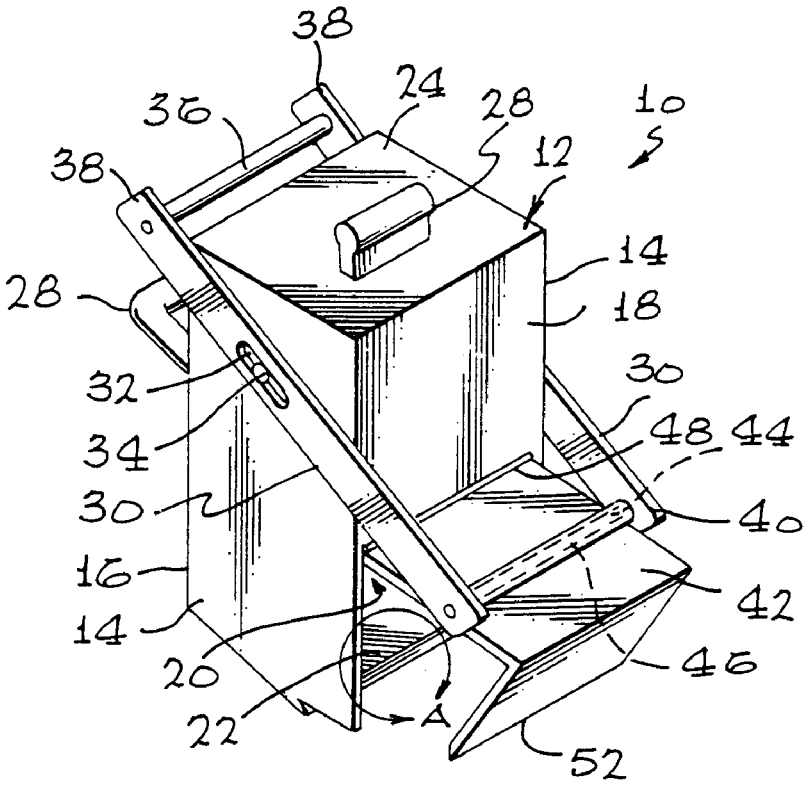
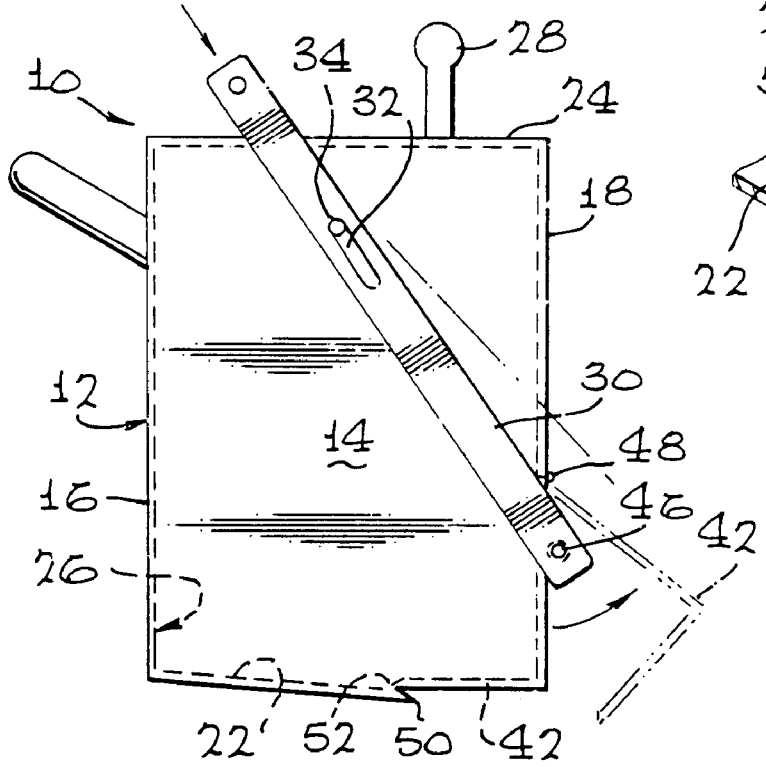
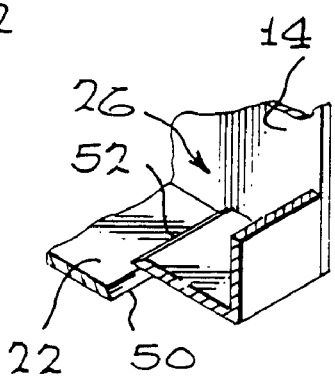
FIG. 2
FIG. 3

APPARATUS AND METHOD FOR DISPOSING OF PET WASTE

BACKGROUND OF THE INVENTION

The present invention is directed generally to an apparatus for disposing of pet waste and the like and more particularly to an improved apparatus and method by which pet waste and the like may be easily picked up, carried and disposed of without soiling one's hands.

Due to increasing pet population, certain large cities have adopted ordinances requiring pet owners to clean up after their pets. Even in areas where such cleanliness is not a prescribed ordinance, it is often desirable to dispose of pet waste and the like in order to maintain attractive lawns which are safe to walk on without soiling one's shoes.

There have been various attempts to deal with these problems in the past. Some individuals have been known to place one of their hands inside a bag of flexible material, such as plastic, as if it were a glove, pick up the waste material using the "gloved" hand, and pull the end of the bag off of the hand in a manner so as to invert the bag around the waste material and package it for later disposal. However, this "gloved" hand method is esthetically unpleasing, and otherwise unpleasant to the pet owner, particularly if the bag breaks at an in opportune moment.

Other devices utilize a plastic bag and a frame, or multiple frames, that may be collapsible and are used as scoops or shovels to place the waste material within the bag so that the bag may be inverted around the excrement and packaged for disposal. However, oftentimes these frame and bag devices are non-intuitive in use, do not adequately pick up the pet excrement, and due to the flimsy materials are prone to breakage.

Accordingly, there is a continuing need for an apparatus for picking up and dispensing pet waste, such as dog excrement. The present invention fulfills this need and provides other related advantages.

SUMMARY OF THE INVENTION

The present invention resides in an apparatus for disposing pet waste. The apparatus generally comprises a housing defining a pet waste receiving opening, and an internal temporary pet waste storage area. In a particularly preferred embodiment, the housing has a base with a beveled front edge. A pair of control arms are slidably connected to opposite side walls of the housing. Typically, each control arm has an elongated slot that receives a peg extending from the side wall. A handle extends between first ends of the control arms for controlling the position of the control arms.

An L-shaped door is pivotally connected at one end to a front wall of the housing adjacent the pet waste receiving opening. The door is also pivotally connected to the control arms so as to be movable between open and closed positions. In a particularly preferred embodiment, a front edge of the door is beveled to cooperate with the front edge of the base, which is often disposed at an angle, to capture pet excrement within the housing. Also, the housing preferably includes one or more handles extending therefrom to assist in positioning and scooping of the pet excrement.

In use, the control arm handle is pushed forward to open the door. The pet waste receiving opening is placed behind the pet waste, and the handle of the control arms is pulled to close the door and capture the pet waste within the pet waste storage interior area of the housing. The owner may push the housing forward such that the beveled base slides under the pet excrement, while the front edge of the door scoops the pet excrement into the housing.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings:

FIG. 1 is a perspective view of an apparatus embodying the present invention, having a scooping door thereof in an open position;

FIG. 2 is an enlarged view of area "A" of FIG. 1, illustrating the use of beveled edges in accordance with the present invention; and FIG. 3 is a side view illustrating the apparatus with its door closed.

DETAILED DESCRIPTION OF THE PREFERRED EMBODIMENT

As shown in the drawings for purposes of illustration, the present invention resides in an apparatus, generally referred to by the reference number 10, for dispensing of pet waste. With reference to FIG. 1, the apparatus 10 includes a housing 12 which is typically rectangular in shape. The housing has opposing side walls 14, a back wall 16, a front wall 18 that is shorter than the back wall to form a pet waste receiving opening 20, together with base 22. The side walls 14, back wall 16, front wall 18 and top wall 24 define an enclosure which is referred to in this application as an internal temporary pet waste storage area 26. Preferably, the housing 12 includes one or more handles 28 extending therefrom. As illustrated, a handle 28 extends from the top wall 24 of the housing 12, and another handle 28 extends rearwardly from the back wall 16 at an angle, as shown in FIG. 3.

A pair of control arms 30 each include an elongated slot 32 which receives a pin or peg 34 extending from the side wall 14 of the housing 12 in order to allow the control arms 30 to slide up and down with respect to the housing 12. A handle 36, in the form of a rod or the like, extends between first ends 38 of the control arms. Thus, pushing or pulling the handle 36 moves the control arms 30 into different positions relative to the housing 12. Second ends of the control arms 40 are pivotally connected to a L-shaped door 42. Typically, an outer face of the door 42 will have attached thereto a tube, or have formed integrally therewith a tubular passageway 44 through which an axle 46 or the like extends through for connection to the control arms 30 at either end thereof. A first end of the door is pivotally connected to the front wall 18 by a hinge 48 or the like. Thus, pulling the handle 36 upwardly pivots the door 42 at hinge 48, causing the door 42 to open, as illustrated in FIG. 1.

The apparatus 10 is then positioned behind the pet excrement such that the pet excrement lies immediately adjacent to a front edge of the base 22. As shown in FIG. 3, preferably, the base 22 is angled to facilitate a scooping motion. Also, a front edge of the base 50 is preferably beveled to create a sharp edge that can slide underneath the pet excrement. A front leading edge 52 of the door 42 is also beveled, so that it slides under the pet excrement and, in cooperation with the front edge of the base 50, moves the pet excrement into the storage area 26 of the housing 12. This is done by pushing the handle 36 to move the control arms 30 downwardly and dose the door 42, as illustrated in FIG. 3. While the front door 42 is being closed in such a manner, the user may simultaneously move the housing 12 forward by pushing on handle 28 of the housing 12.

The apparatus 10 is preferably comprised of a durable and washable material, such as plastic, aluminum, or even wood. The door 42 is opened over a trash bin or disposal site, and the housing 12 is agitated and shaken using handle grip 28 until the pet excrement becomes dislodged from the housing 12 and exits the opening 20. As needed, the soiled areas of the apparatus 10 can be washed, such as by using water from a hose or the like.

The present invention is advantageous over other methods as it is intuitive in use. Also, the pet owner's hands do not come into contact, either directly or indirectly, with the pet excrement. Moreover, the pet owner need not purchase a supply of bags and remember to bring one or two bags with him or her each time the pet is walked outside.

Although several embodiments of the present invention have been described in detail for purposes of illustration, various modifications of each may be made without departing from the spirit and scope of the invention. Accordingly, the invention is not to be limited, except as by the appended claims.

What is claimed is:

1. An apparatus for disposing of pet waste, the apparatus comprising:

a housing defining a pet waste receiving opening and an internal temporary pet waste storage area;

a pair of control arms slidably connected to opposite side walls of the housing;

a handle extending between first ends of the control arms for controlling the position of the control arms; and an L-shaped door pivotally connected at one end to a front wall of the housing adjacent the pet waste receiving opening, and pivotally connected to the control arms so as to be movable between open and closed positions;

wherein in use the control arm handle is pulled upwardly to open the door, the pet waste receiving opening is placed behind the pet waste, and the handle is pushed to close the door and capture the pet waste within the pet waste storage interior area of the housing.

2. The apparatus of claim 1, including a handle attached to the housing.

3. The apparatus of claim 2, wherein the handle comprises a handle attached to a top surface of the housing and a handle attached to a back wall of the housing.

4. The apparatus of claim 1, wherein each control arm includes an elongated slot that receives a peg extending from a side wall of the housing.

5. The apparatus of claim 1, wherein the housing includes a base having a beveled front edge.

6. The apparatus of claim 5, wherein the base is disposed at an angle.

7. The apparatus of claim 5, wherein a front edge of the door is beveled to cooperate with the front edge of the base to capture pet excrement within the housing.

8. An apparatus for disposing of pet waste, the apparatus comprising:

a housing defining a pet waste receiving opening and an internal temporary pet waste storage area, the housing having a base having a beveled front edge;

a handle attached to the housing;

a pair of control arms slidably connected to opposite side walls of the housing, each control arm having an elongated slot that receives a peg extending from a side wall of the housing;

a handle extending between first ends of the control arms for controlling the position of the control arms; and an L-shaped door pivotally connected at one end to a front wall of the housing adjacent the pet waste receiving opening, and pivotally connected to the control arms so as to be movable between open and dosed positions;

wherein in use the control arm handle is pulled upwardly to open the door, the pet waste receiving opening is placed behind the pet waste, and the handle is pushed to close the door and capture the pet waste within the pet waste storage interior area of the housing.

9. The apparatus of claim 8, wherein the handle comprises a handle attached to a top surface of the housing and a handle attached to a back wall of the housing.

10. The apparatus of claim 8, wherein the base is disposed at an angle.

11. The apparatus of claim 8, wherein a front edge of the door is beveled to cooperate with the front edge of the base to capture pet excrement within the housing.

* * * * *